US011510440B2

(12) United States Patent
Kardashian West et al.

(10) Patent No.: US 11,510,440 B2
(45) **Date of Patent: *Nov. 29, 2022**

(54) SHAPEWEAR UNDERGARMENT

(71) Applicant: Skims Body, Inc., Culver City, CA (US)

(72) Inventors: Kimberly Kardashian West, Culver City, CA (US); Jens Grede, Culver City, CA (US)

(73) Assignee: Skims Body, Inc., Culver City, CA (US)

( * ) Notice: Subject to any disclaimer, the term of this patent is extended or adjusted under 35 U.S.C. 154(b) by 169 days.

This patent is subject to a terminal disclaimer.

(21) Appl. No.: 17/029,350

(22) Filed: Sep. 23, 2020

(65) Prior Publication Data

US 2021/0000189 A1 Jan. 7, 2021

Related U.S. Application Data

(63) Continuation of application No. 16/712,464, filed on Dec. 12, 2019, now Pat. No. 10,806,190, which is a continuation-in-part of application No. 29/694,603, filed on Jun. 12, 2019.

(51) Int. Cl.

| | |
|---|---|
| ***A41B 11/14*** | (2006.01) |
| ***A41B 9/00*** | (2006.01) |
| ***A41B 9/04*** | (2006.01) |

(52) U.S. Cl.

CPC ..... *A41B 9/001* (2013.01); *A41B 9/04* (2013.01); *A41B 11/14* (2013.01); *A41B 2400/38* (2013.01)

(58) Field of Classification Search

CPC A41B 9/04; A41B 9/001; A41B 11/14; A41C 1/003; A42B 2400/38; A41D 13/06; A41D 13/0543

See application file for complete search history.

(56) References Cited

U.S. PATENT DOCUMENTS

| | | | | |
|---|---|---|---|---|
| 2,348,242 | A | 5/1944 | Bullinger | |
| 2,487,893 | A * | 11/1949 | Rockwell | A41C 1/003 450/130 |
| 2,651,048 | A | 9/1953 | Milberg | |
| 3,547,128 | A | 12/1970 | Keltner | |
| 3,590,823 | A | 7/1971 | Pope, Jr. | |
| 4,019,208 | A | 4/1977 | Walser, Jr. et al. | |
| 4,106,514 | A | 8/1978 | Lowth | |
| D258,770 | S | 4/1981 | Stern | |

(Continued)

FOREIGN PATENT DOCUMENTS

DE 202017101232 U1 4/2017

OTHER PUBLICATIONS

International Search Report and Written Opinion issued in corresponding application No. PCT/US2019/066011 dated Mar. 18, 2020, 15 pages.

(Continued)

*Primary Examiner* — Tajash D Patel
(74) *Attorney, Agent, or Firm* — Peame & Gordon LLP

(57) ABSTRACT

A shapewear undergarment can include first and second leg openings where the first leg opening is located at a greater distance from a hip portion than the second leg opening, (Continued)

such that the shapewear undergarment will cover a greater portion of a wearer's first thigh than the wearer's second thigh when worn.

20 Claims, 4 Drawing Sheets

(56) References Cited

U.S. PATENT DOCUMENTS

| | | | | |
|---|---|---|---|---|
| 5,097,537 | A | 3/1992 | Ewing | |
| 5,191,659 | A | 3/1993 | Backus | |
| 5,890,231 | A | 4/1999 | Ueda | |
| 6,023,789 | A | 2/2000 | Wilson et al. | |
| 6,704,942 | B2 | 3/2004 | Lazarian | |
| 9,427,029 | B2 | 8/2016 | Castellano | |
| D816,293 | S | 5/2018 | Miller | |
| D816,944 | S | 5/2018 | Gonzalez | |
| D822,345 | S | 7/2018 | Swersky | |
| 10,278,431 | B2 | 5/2019 | McClean | |
| 10,806,190 | B1 * | 10/2020 | Kardashian West ... | A41B 9/001 |
| 2006/0085895 | A1 | 4/2006 | Wojeski et al. | |
| 2010/0281601 | A1 | 11/2010 | Clarke et al. | |
| 2011/0000005 | A1 | 1/2011 | Brown | |
| 2013/0095730 | A1 * | 4/2013 | Jensen ..... | A41D 1/06 450/95 |
| 2014/0273735 | A1 | 9/2014 | Cohen Larren et al. | |
| 2015/0038052 | A1 | 2/2015 | Hays | |
| 2018/0263299 | A1 | 9/2018 | Padin | |

OTHER PUBLICATIONS

"Kim Kardashian launches one-legged shapewear brand Kimono and Chrissy Teigen is first in line," https://metro.co.uk (retrieved at: https://metro.co.uk/2019/06/25/kim-kardsahian-launches-one-legged-shapewear-brand-kimono-chrissy-teigen-first-line-10070956/; date Jun. 25, 2019.

Wirarpa Women's Anti Chafing Cotton Underwear Boy Shorts Bike Long Leg, posted 2020 (online), captured Oct. 23, 2020 https://www.amazon.com/wirarpa-Womens-Chafing-Cotton-Underwear/dp/B07S8RMSRM/ref=sr_1_2?dchild=1&keywords=wirarpa%2Bwomen%27s%2Banti%2Bchafing%2Bcotton%2Bunderwear%2Bboy%2Bshorts%2Bbike%2Blong%2Bleg&qid=1603471184&sr=8-2&th=1.

Solution Short #1, posted 2020 (online), captured Oct. 23, 2020 https://www.nordstrom.com/s/skims-solution-short-1-regular-plus-size/5543646.

Joyshaper Slip Shorts for Under Dress Anti Chafing Thigh Bands Underwear Women Girls Lace Stretch Safety Pants, posted 2019 (online). captured Oct. 23, 2020 https://www.amazon.com/womens-shapewear-boyshort-seamless-panties/dp/B07PQK9YKS/ref=bmx_7_encoding=utf8&pd_rd_i=b.

High-waist One-leg Shaper Short, posted 2020 (online). captured Sep. 21, 2020. https:www.victoriassecret.com/us/vs/sleepwear-and-lingerie-catalog/leonisa-shapewear-high-waist-one-leg-shaper-short-1118220400.

* cited by examiner

SHAPEWEAR UNDERGARMENT

CROSS-REFERENCE TO RELATED APPLICATIONS

This application is a continuation of U.S. patent application Ser. No. 16/712,464 filed Dec. 12, 2019, which is a continuation-in-part of U.S. patent application Ser. No. 29/694,603 filed Jun. 12, 2019, the contents of each of which are incorporated by reference.

BACKGROUND

Shapewear is used to smooth or sculpt the wearer's body to achieve a desired shape or contour. Shapewear can be worn under clothing to provide an enhanced, smoother, and/or slimmer appearance.

SUMMARY OF INVENTION

A shapewear undergarment is disclosed. The undergarment is made of elastic, form-fitting material adapted to smooth, compress, and/or sculpt a body of a wearer. The undergarment has a hip portion adapted to be worn over the wearer's hips, and first and second openings to accommodate the wearer's first and second legs respectively therethrough. The first opening is located a greater distance than the second opening downward relative to the hip portion such that the shapewear undergarment will cover a greater portion of the wearer's first thigh than of the wearer's second thigh when worn.

DETAILED DESCRIPTION

Figure 3:
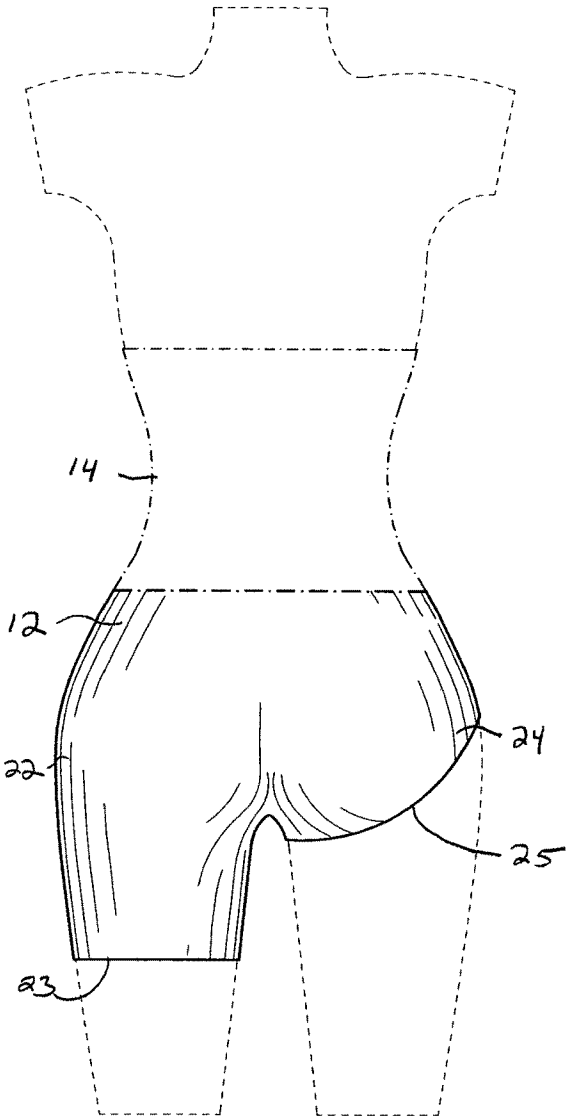
FIG. 3 shows a rear view of the shapewear undergarment of FIG. 1.
Figure 2:
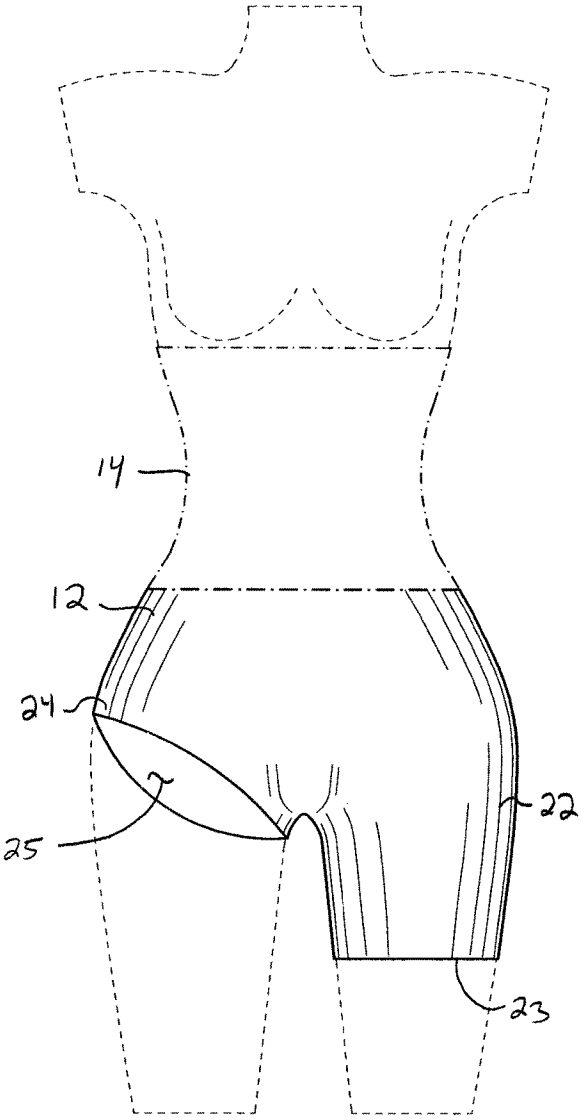
FIG. 2 shows a front view of the shapewear undergarment of FIG. 1.
Figure 1:
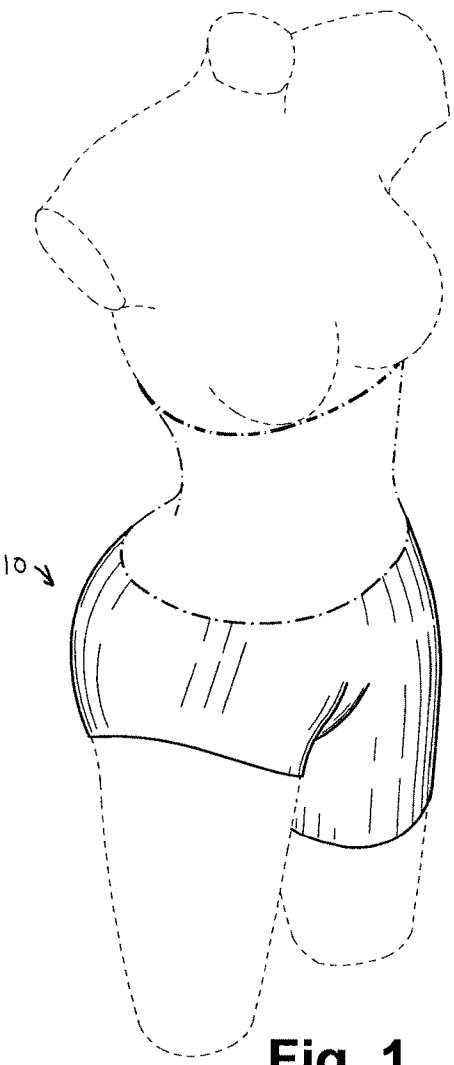
FIG. 1 shows a perspective view of a shapewear undergarment as disclosed herein.
Figure 6:
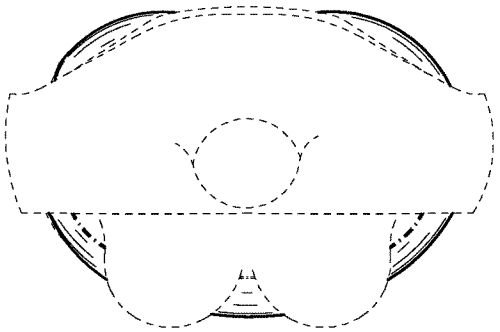
FIG. 6 shows a top view of the shapewear undergarment of FIG. 1.
Figure 7:
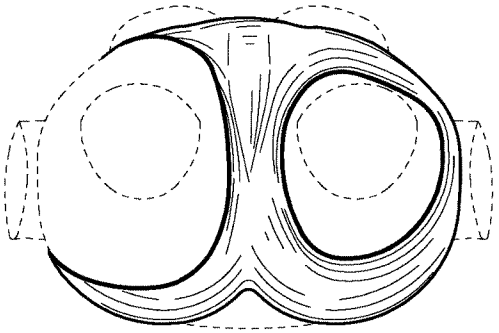
FIG. 7 shows a bottom view of the shapewear undergarment of FIG. 1.
Figure 5:
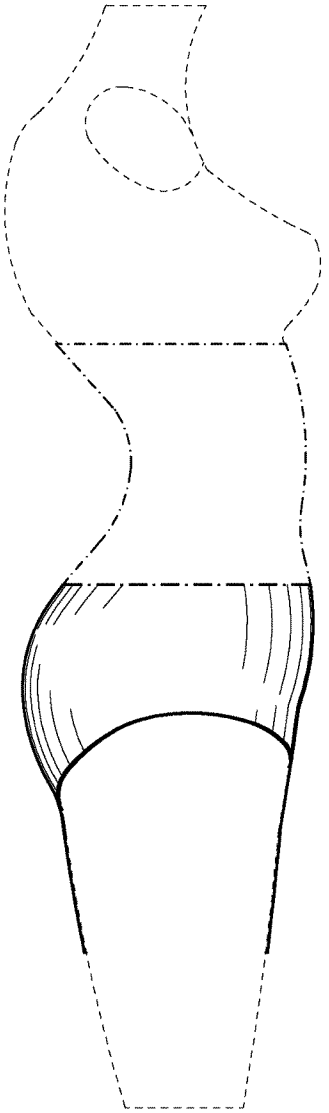
FIG. 5 shows a left-side view of the shapewear undergarment of FIG. 1.
Figure 4:
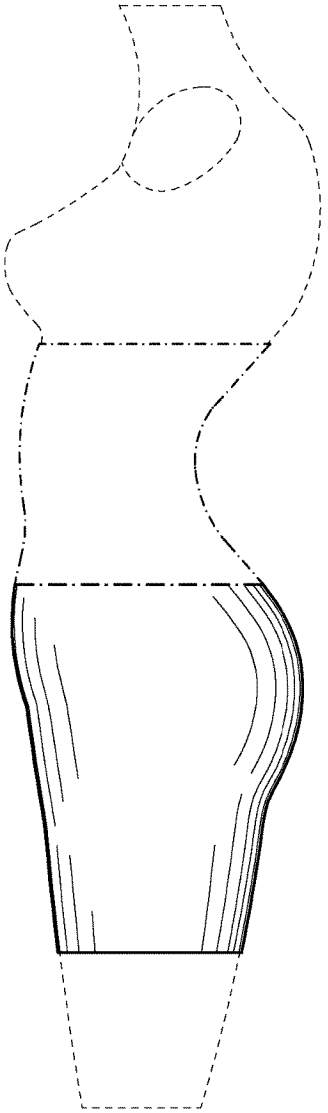
FIG. 4 shows a right-side view of the shapewear undergarment of FIG. 1.
Figure 10:
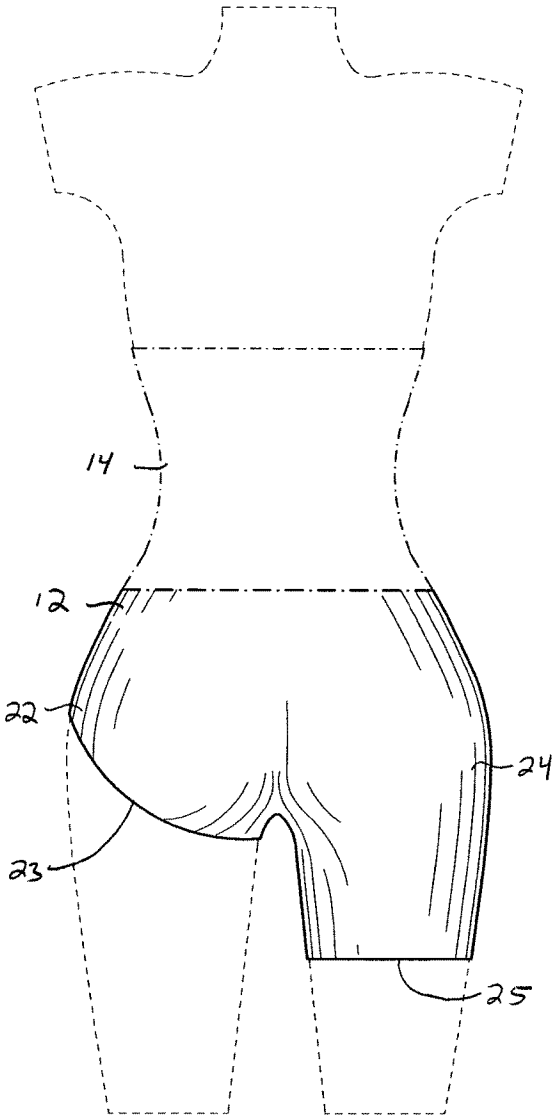
FIG. 10 shows a rear view of the shapewear undergarment of FIG. 8.
Figure 9:
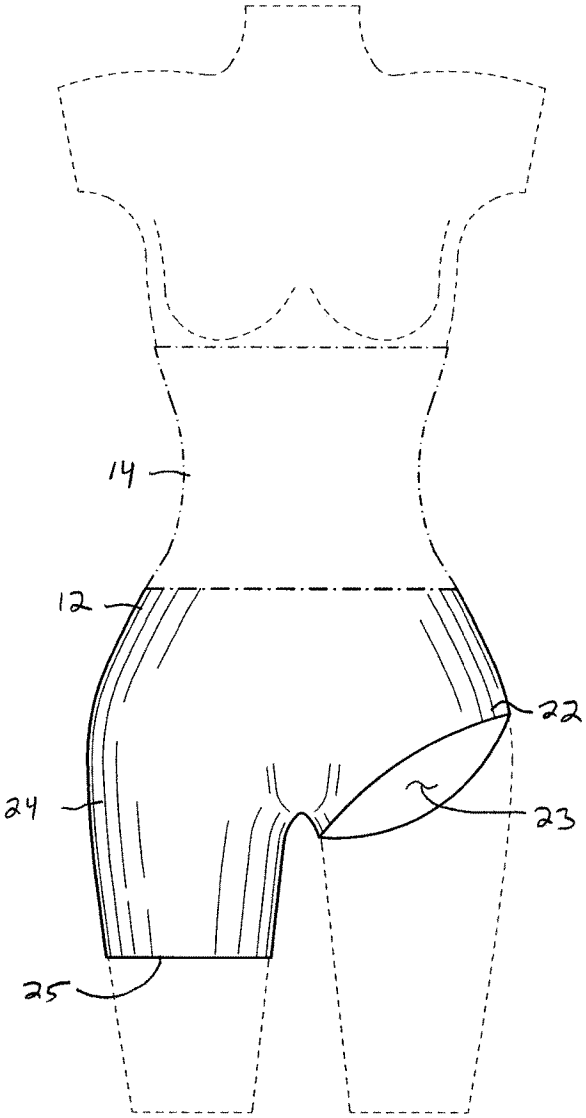
FIG. 9 shows a front view of the shapewear undergarment of FIG. 8.
Figure 8:
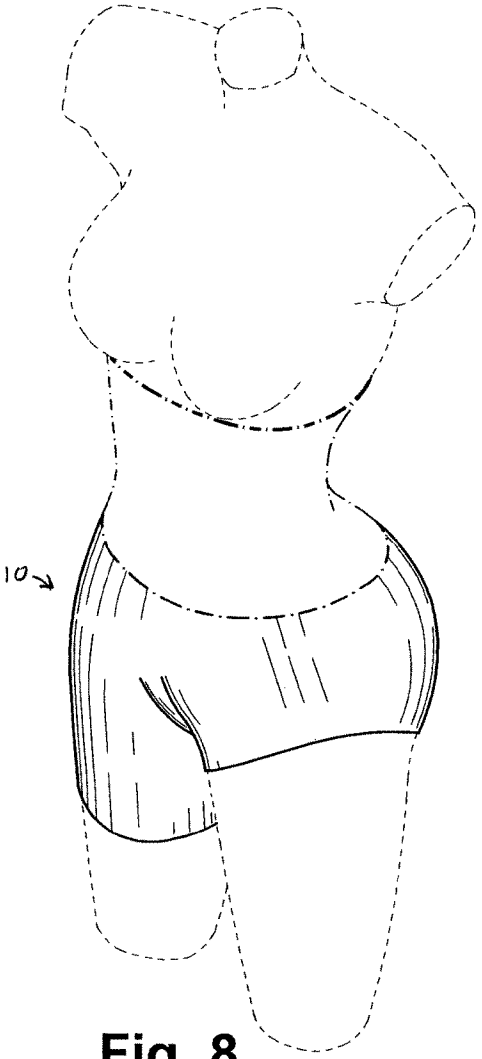
FIG. 8 shows a perspective view of a shapewear undergarment as disclosed herein.
Figure 13:
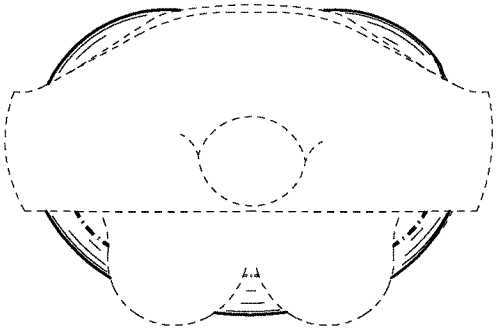
FIG. 13 shows a top view of the shapewear undergarment of the embodiment of FIG. 8.
Figure 14:
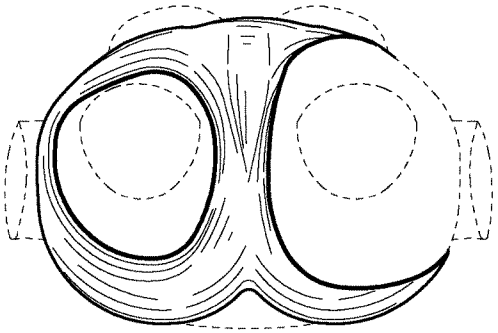
FIG. 14 shows a bottom view of the shapewear undergarment of FIG. 8.
Figure 12:
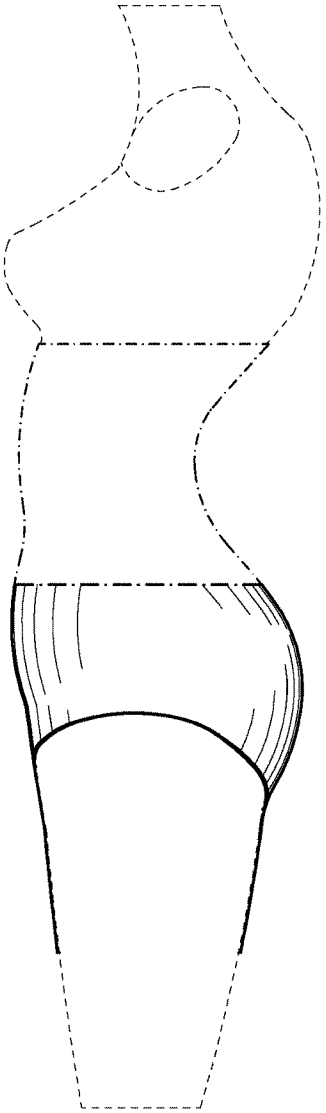
FIG. 12 shows a right-side view of the shapewear undergarment of FIG. 8.
Figure 11:
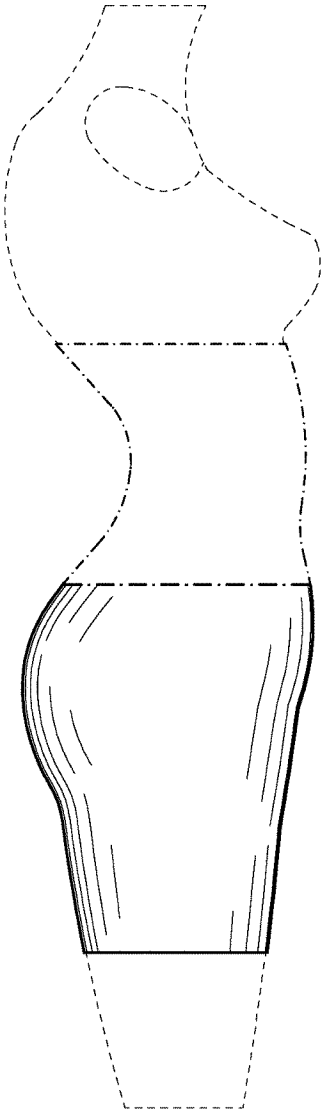
FIG. 11 shows a left-side view of the shapewear undergarment of FIG. 8.

Referring first to FIG. 1, a shapewear undergarment 10 in the form of a short is shown being worn on an imaginary human form. The undergarment has a hip portion 12 adapted to be worn over the wearer's hips. Respective first and second leg portions 22 and 24 depend from the hip portion 12 in a conventional manner and are adapted to receive and be worn over upper portions of the wearer's legs, for example over the thighs. As seen in FIGS. 1-3, the leg portions 22 and 24 are asymmetrical and of different lengths such that in this embodiment the second leg portion 24 has a length that is shorter than a length of the first leg portion 22. Accordingly, the first leg 22 portion extends a greater distance down one leg than does the second leg portion 24 down the other leg when worn. In this manner, when worn with the second leg portion 24 over a wearer's right leg, a greater portion of the wearer's upper right leg, e.g. the right thigh, will be exposed from the shapewear undergarment 10 as compared to the left leg. The shapewear undergarment 10 can be configured with the first leg portion 22 corresponding to a wearer's left leg and the second leg portion 24 corresponding to a wearer's right leg or vice versa. The shapewear undergarment 10 can also be configured in a reversible manner such that a wearer may turn the shapewear undergarment 10 around such that the first leg portion 22 can be worn on either leg, as desired. Alternatively, the shapewear undergarment 10 may only include a single leg portion, such that one leg of the wearer is entirely exposed while the other is partially covered by the single leg portion. All these configurations can be useful, for example, when wearing clothing over the shapewear, such as a dress or a skirt having a high slit or opening on one side, pants, such as distressed denim, exposing an upper portion of one thigh, or one-legged outfits so that one of the wearer's upper leg and thigh can be exposed without the shapewear undergarment 10 also being seen.

The shapewear undergarment 10 seen in FIGS. 1-7 can be of any suitable size and color and is made from an elastic, form-fitting material, such as nylon, spandex, polyester, cotton, microfibers, a blend of the above, and/or any other suitable material as known in the art, to perform its function of smoothing, enhancing, compressing, and sculpting the body of the wearer to achieve a desirable shape or contour underneath clothing. The shapewear undergarment 10 can offer varying degrees of compression to the wearer. For instance, the shapewear undergarment 10 may be of a light, medium, or high compression. Additionally or alternatively, the shapewear undergarment 10 may include a material of higher compression or support in one portion, such as in an abdomen or waist portion, and in another portion use a lighter compression or support material, such as in first and/or second leg portions 22, 24. The material may transition from lighter compression near edges of the shapewear undergarment 10 to higher or firmer compression near a central portion of the shapewear undergarment 10 to minimize bulging at the edges when worn. Using the disclosed asymmetrical shapewear undergarment 10, the wearer can enjoy and benefit from its shapewear function of the hips, rear, and one thigh while leaving the other thigh largely or entirely exposed. Accordingly, the exposed thigh, but not the shapewear undergarment 10, can be seen through the aforementioned opening in the clothes worn thereover.

Returning to FIGS. 1-3, in the illustrated embodiment, the opening 23 of the first leg portion 22, through which the wearer's left leg will extend when worn, is substantially straight and horizontal when viewed from the front or rear. However, the opening 25 of the second leg portion 24 is upswept from the crotch or inner thigh portion of the undergarment 10, laterally outward toward the hip of the wearer. This enables the undergarment 10 to provide appropriate support and fitment at the crotch, while exposing an appreciable portion of the wearer's hip, which may be desirable in some applications.

As also seen in the illustrated embodiment, the front of the opening 25 of the second leg portion 24 in FIGS. 1-3 follows a substantially concave profile, to accommodate the front hip of the wearer where the leg meets the torso, more like a bikini. Whereas, the rear of the opening 25 of the second leg portion 24 in those figures follows a substantially convex profile, which may better accommodate and provide support to the wearer's buttock. However, it is to be appreciated that the front and rear opening may follow the same profile, which can be useful in a reversible construction.

In the illustrated embodiment shown in FIGS. 1-7, the hip portion 12 of the shapewear undergarment 10 stops below the wearer's natural waist, leaving a larger portion of the wearer's abdomen or midsection exposed and unsupported by the undergarment 10. However, the shapewear undergarment can also include a waist or midsection portion 14 connected to and extending upward from the hip portion 12, to provide additional shaping and support to the wearer's waist and midriff.

FIG. 8-14 illustrate a further embodiment of the shapewear undergarment 10 identical to that of FIGS. 1-7, except that it is a mirror-image thereof. That is, in the embodiment illustrated in FIGS. 1-7, the right-leg portion is shorter than the left-leg portion; whereas in FIGS. 8-14, the left-leg portion is shorter than the right-leg portion, so that the wearer's left upper leg and thigh will be exposed and thus visible, without perceiving the undergarment 10, thorough an opening in clothing worn thereover.

Although the invention has been described herein with respect to preferred embodiments, it is to be appreciated that the invention is not necessarily limited thereto and is intended to encompass all embodiments coming within the spirit and scope of the invention as set forth in the appended claims.

What is claimed is:

1. A shapewear undergarment made from elastic, form-fitting material adapted to compress a body of a wearer, and comprising a hip portion adapted to be worn over the wearer's hips, and first and second openings to accommodate the wearer's first and second legs respectively therethrough, said first opening being located a greater distance than said second opening downward relative to the hip portion such that said shapewear undergarment will cover a greater portion of the wearer's first thigh than of said wearer's second thigh when worn, wherein said first opening is substantially horizontal when viewed from a front of the undergarment, wherein said second opening is upswept from a crotch of said undergarment laterally outward, and wherein a front edge and a rear edge of said second opening conform to substantially the same profile such that the undergarment is reversible so that said second leg accommodated by the second opening can be either the wearer's right leg or the wearer's left leg.

2. The shapewear undergarment of claim 1, said undergarment being made as one piece from said elastic, form-fitting material.

3. The shapewear undergarment of claim 1, wherein said form-fitting material transitions from applying lighter compression near an edge of the shapewear undergarment to higher compression remote from said edge to minimize bulging at the edge when worn.

4. The shapewear undergarment of claim 1, said undergarment further comprising a midsection portion extending upward from said hip portion and adapted to provide shaping to the wearer's midsection.

5. A shapewear undergarment made from elastic, form-fitting material adapted to compress a body of a wearer, and comprising a hip portion adapted to be worn over the wearer's hips, and first and second openings to accommodate the wearer's first and second legs respectively therethrough, said first opening being located a greater distance than said second opening downward relative to the hip portion such that said shapewear undergarment will cover a greater portion of the wearer's first thigh than of said wearer's second thigh when worn, wherein said form-fitting material transitions from applying lighter compression near an edge of the shapewear undergarment to higher compression remote from said edge to minimize bulging at the edge when worn.

6. The shapewear undergarment of claim 5, wherein a front edge and a rear edge of said second opening conform to substantially the same profile such that undergarment is reversible so that said second leg accommodated by the second opening can be either the wearer's right leg or the wearer's left leg.

7. The shapewear undergarment of claim 5, said undergarment being made as one piece from said elastic, form-fitting material.

8. The shapewear undergarment of claim 5, said undergarment further comprising a midsection portion extending upward from said hip portion and adapted to provide shaping to the wearer's midsection.

9. The shapewear undergarment of claim 5, said first opening being located fully below said second opening, and wherein a front edge of said second opening is vertically spaced from a rear edge of said second opening.

10. The shapewear undergarment of claim 9, wherein said front edge of said second opening follows a substantially concave profile extending upward when viewed from a front of said undergarment.

11. The shapewear undergarment of claim 9, said rear edge of said second opening following a substantially convex profile extending downward when viewed from a rear of said undergarment.

12. A method of sculpting a body of a wearer, comprising fitting to the wearer a shapewear undergarment having a hip portion worn over said wearer's hips, and first and second openings that accommodate the wearer's first and second legs respectively therethrough, said first opening being located a greater distance than said second opening downward relative to the hip portion such that the shapewear undergarment covers a greater portion of the wearer's first thigh than of said wearer's second thigh.

13. The method of claim 12, further comprising fitting to the wearer a dress having a slit that exposes the wearer's second leg through the dress, said shapewear undergarment being not visible on the wearer's second leg through said slit.

14. The method of claim 12, said undergarment being made as one piece from elastic, form-fitting material.

15. The method of claim 14, wherein said form-fitting material transitions from applying lighter compression near an edge of the shapewear undergarment to higher compression remote from said edge to minimize bulging at the edge when worn.

16. The method of claim 12, said undergarment further comprising a midsection portion extending upward from said hip portion, wherein the midsection portion provides shaping to the wearer's midsection.

17. The method of claim 12, wherein a front edge of said second opening is vertically spaced from a rear edge of said second opening.

18. The method of claim 17, wherein said front edge of said second opening follows a substantially concave profile when viewed from in front of the wearer.

19. The method of claim 12, said undergarment further comprising first and second leg portions depending from said hip portion and having the first and second openings respectively therein.

20. The method of claim 12, said second opening being upswept from a crotch of said undergarment laterally outward.

* * * * *